US008640631B2

(12) United States Patent
Josephson et al.

(10) Patent No.: US 8,640,631 B2
(45) Date of Patent: Feb. 4, 2014

(54) SIDE CONTOURED OPEN TOP HOPPER RAILCAR WITH BIASED DOOR SEAL AND ENLARGED CONTOURED END DOOR

(75) Inventors: Gregory P Josephson, Salix, PA (US); David A. Lohr, Soystown, PA (US)

(73) Assignee: JAC Operations, Inc., Chicago, IL (US)

( * ) Notice: Subject to any disclaimer, the term of this patent is extended or adjusted under 35 U.S.C. 154(b) by 0 days.

(21) Appl. No.: 13/554,063

(22) Filed: Jul. 20, 2012

(65) Prior Publication Data

US 2013/0032055 A1 Feb. 7, 2013

Related U.S. Application Data

(63) Continuation of application No. PCT/US2011/022293, filed on Jan. 24, 2011.

(60) Provisional application No. 61/297,485, filed on Jan. 22, 2010.

(51) Int. Cl.
*B61D 7/00* (2006.01)

(52) U.S. Cl.
USPC ..... 105/247; 105/248; 105/253

(58) Field of Classification Search
USPC ..... 105/238.1, 244, 247, 248, 249, 250, 105/296, 397, 404
See application file for complete search history.

(56) References Cited

U.S. PATENT DOCUMENTS 144,966 A 11/1873 Elliott et al.
147,341 A 2/1874 Meyer
162,189 A 4/1875 Pierce
217,289 A 7/1879 Kane
347,523 A 8/1886 Scully
349,134 A 9/1886 Barr
369,102 A 8/1887 Davis
500,846 A 7/1893 Blackstone
528,279 A 10/1894 Roberts
568,775 A 10/1896 Lane
658,783 A 10/1900 King
699,820 A 5/1902 Sage
743,501 A 11/1903 Hansen
763,186 A 6/1904 Johnson
797,341 A 8/1905 Brown
881,884 A 3/1908 Dodds
891,325 A 6/1908 Butchart
914,242 A 3/1909 Campbell
937,419 A 10/1909 Campbell
1,182,642 A 5/1916 Clark
1,300,959 A 4/1919 Hart
1,418,907 A 6/1922 Campbell
(Continued)

*Primary Examiner* — Jason C Smith
(74) *Attorney, Agent, or Firm* — Blynn L Shideler; Krisanne Shideler; BLK Law Group

(57) ABSTRACT

A railroad open top hopper car comprises a pair of spaced trucks supporting a railcar body, the body comprising a pair of side structures railcar, wherein each including (i) a top chord extending the side structure length, (ii) a plurality of upper side stakes extending from the top chord, (iii) an intermediate side chord extending the side structure length and below the top chord and coupled to the upper side stakes, (iv) a plurality of lower side stakes extending from the intermediate side chord, and (v) a side sill extending the length and below the intermediate side chord and coupled to the lower side stakes. The body forms discharge chutes forming pockets for the body with a plurality of intermediate doors and end doors, wherein the end doors are larger than the intermediate doors. Each door may include a biased door seal.

14 Claims, 5 Drawing Sheets

(56) References Cited

U.S. PATENT DOCUMENTS

| | | | | | |
|---|---|---|---|---|---|
| 1,444,730 | A | | 2/1923 | Christianson | |
| 2,079,862 | A | | 5/1937 | Kesel, Jr. | |
| 3,080,829 | A | | 3/1963 | Damy | |
| 3,104,623 | A | | 9/1963 | Dorey | |
| 3,187,684 | A | | 6/1965 | Ortner | |
| 3,242,878 | A | | 3/1966 | Floehr | |
| 3,256,836 | A | | 6/1966 | Floehr | |
| 3,348,501 | A | | 10/1967 | Stevens | |
| 3,509,827 | A | * | 5/1970 | Sutter | 105/248 |
| 3,577,932 | A | | 5/1971 | Pulcrano et al. | |
| 4,228,742 | A | | 10/1980 | Przybylinski et al. | |
| 4,292,898 | A | | 10/1981 | Gordon et al. | |
| 4,361,096 | A | * | 11/1982 | Funk | 105/248 |
| 4,366,757 | A | | 1/1983 | Funk | |
| 4,376,542 | A | * | 3/1983 | Hennessy | 277/637 |
| 4,644,871 | A | * | 2/1987 | Arrey et al. | 105/4.1 |
| 4,884,511 | A | | 12/1989 | Hallam et al. | |
| 5,070,793 | A | * | 12/1991 | Kurtz et al. | 105/406.1 |
| 5,249,531 | A | | 10/1993 | Taylor | |
| 5,417,165 | A | | 5/1995 | Peppin et al. | |
| 5,934,200 | A | * | 8/1999 | Lydic | 105/248 |
| 5,979,335 | A | * | 11/1999 | Saxton et al. | 105/404 |
| 6,273,004 | B1 | * | 8/2001 | Klag | 105/404 |
| 6,334,397 | B1 | * | 1/2002 | Valgora | 105/409 |
| 6,405,658 | B1 | * | 6/2002 | Taylor | 105/286 |
| 6,601,522 | B2 | * | 8/2003 | Roxby | 105/355 |
| 6,955,127 | B2 | * | 10/2005 | Taylor | 105/299 |
| 7,080,599 | B2 | | 7/2006 | Taylor | |
| 2006/0254456 | A1 | | 11/2006 | Taylor | |
| 2008/0066642 | A1 | | 3/2008 | Forbes et al. | |
| 2009/0007813 | A1 | | 1/2009 | Early | |
| 2010/0251923 | A1 | * | 10/2010 | Forbes et al. | 105/253 |
| 2012/0199041 | A2 | * | 8/2012 | Forbes et al. | 105/247 |

* cited by examiner

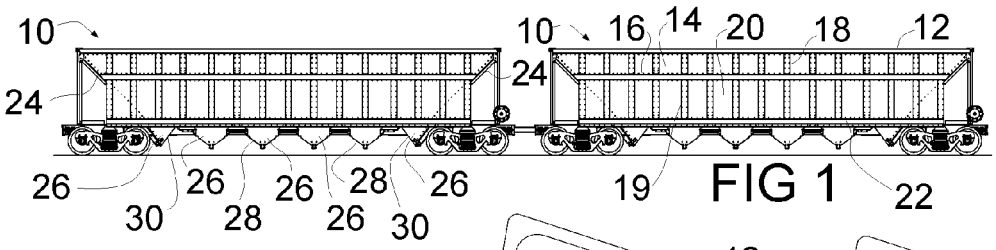
FIG 1
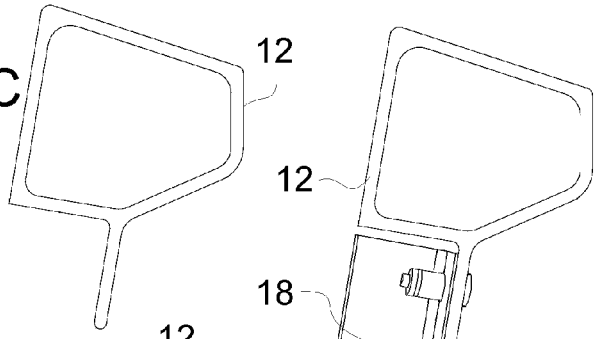
FIG 3C
FIG.3A
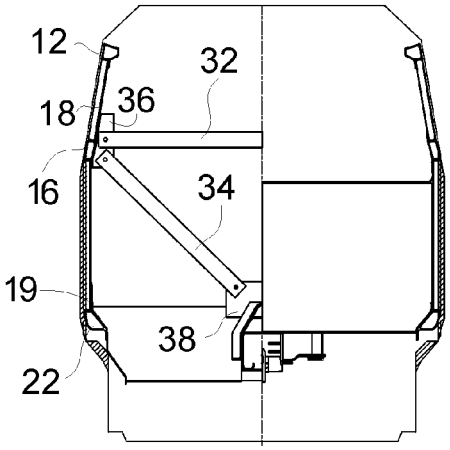
FIG. 2
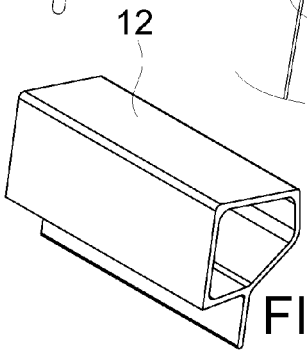
FIG 3B
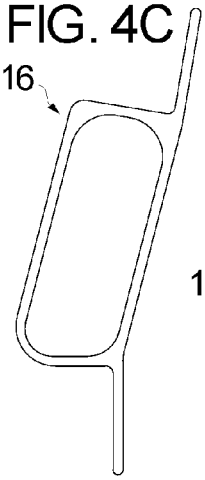
FIG. 4C
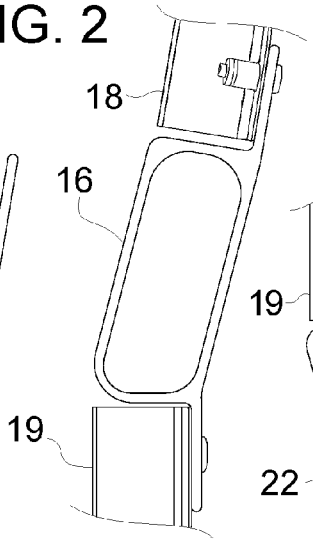
FIG. 4A
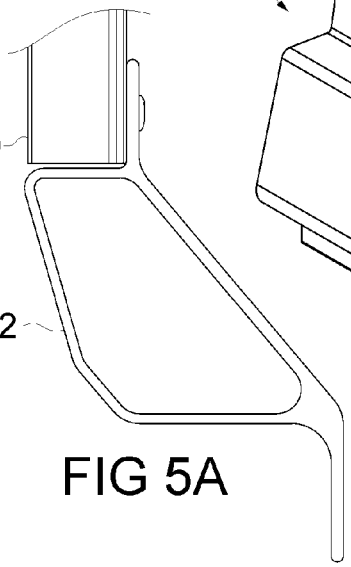
FIG 5A
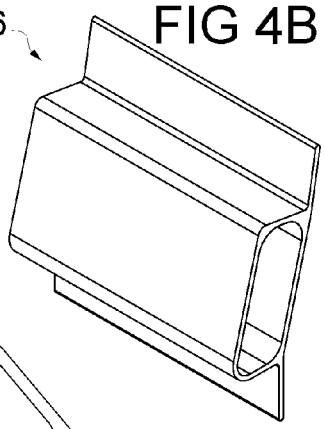
FIG 4B

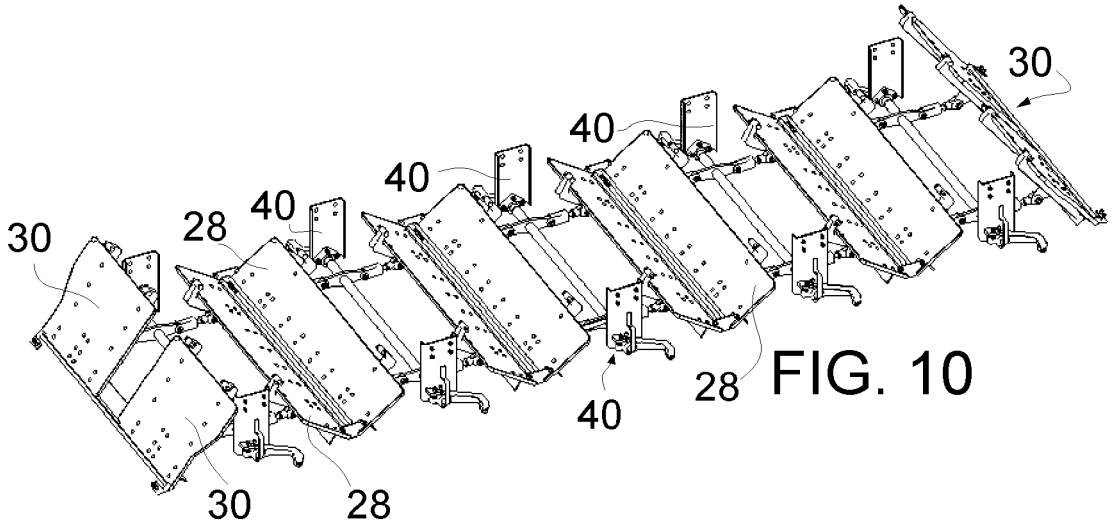
FIG. 10
FIG 11
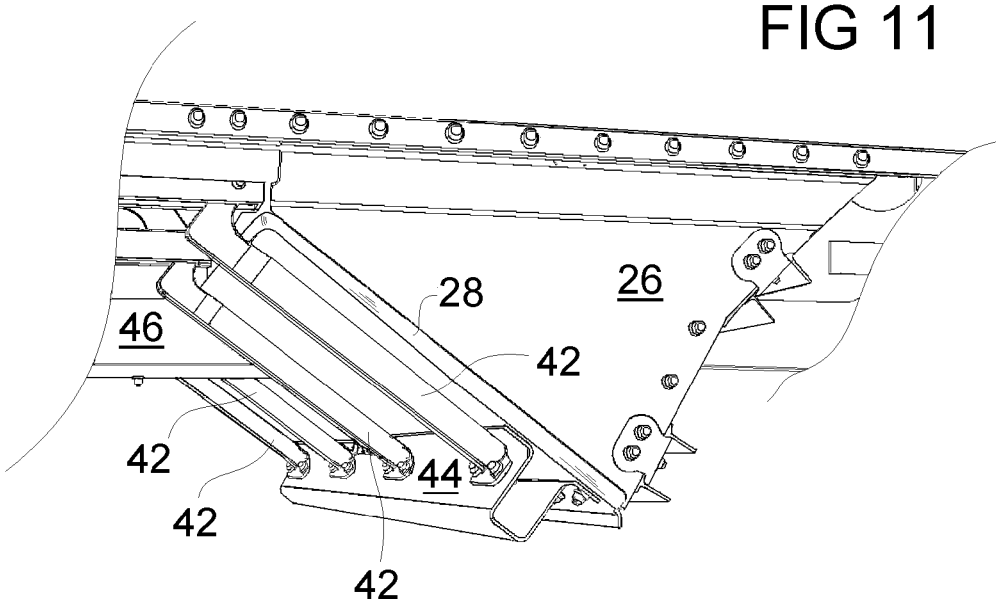

SIDE CONTOURED OPEN TOP HOPPER RAILCAR WITH BIASED DOOR SEAL AND ENLARGED CONTOURED END DOOR

RELATED APPLICATION

The present application is a continuation of international patent application serial number PCT/US11/22293 filed Jan. 24, 2011 and which published as publication number WO/2011/091384 Jul. 28, 2011, which is incorporated herein by reference. International patent application serial number PCT/US11/22293 claims the benefit of U.S. Provisional Patent Application Ser. No. 61/297,485 entitled "Side Contoured Open Top Hopper Railcar with Biased Door Seal and Enlarged Contoured End Door" filed Jan. 22, 2010.

BACKGROUND OF THE INVENTION

1. Field of the Invention

The present invention relates to a railroad hopper cars, and more particularly to the side and door structures for an open top hopper railcar.

2. Background Information

A hopper railcar, or hopper car, is a railcar used to transport loose bulk commodities such as grain, coal, minerals, fertilizers, cement, etc. The hopper car interior is typically divided into pockets or hoppers with doors on the bottom of each pocket to empty cargo by the force of gravity, making for quick and effective unloading. The discharge doors do not prevent the use of a rotary unloader that pivots the entire car, but the discharge doors on the bottom do not require the use of such a rotary unloader.

Further the hopper railcars may be closed hopper railcars or open top railcars that are easy for top loading. Even with "open top" hopper railcars, removable covers can be used for transport and other specialized tops could be used with a hopper railcar depending upon the intended cargo.

Closed railway hopper cars with pneumatic systems for unloading are often used for the transportation of powdered and granular products. For cars with positive pressure pneumatic systems, air may be supplied from an external source to pressurize the interior of the car body and simultaneously fluidize the dry, bulk product carried within the car to enable it to be conveyed in a fluidized state through product transfer conduits from the car to a collection facility. Air pressure within the hopper car during unloading is typically maintained at approximately fifteen pounds per square inch gauge pressure.

The present invention is primarily related to open top hopper cars, but certain aspects of the invention may be used in other car types. The following is a brief discussion to establish the state of the art in open top hopper railcar and door operating systems.

U.S. Pat. Nos. 144,966; 147,341, 162,189; 217,289; 347, 523; 349,134, 369,102; 500,846; 528,279; and 568,775 from about 1873-1889 disclose early proposed hopper railcar designs, which is helpful to illustrate the basic hopper concepts and to better demonstrate hopper car evolution.

U.S. Pat. No. 658,783 discloses early hopper car construction with the body formed of metal sheets coupled together.

U.S. Pat. No. 699,820 discloses a general hopper car and specifically a door operating mechanism for a hopper car, also called a "dumping car" therein.

U.S. Pat. No. 743,501 discloses a hopper car and specifically an ore carrying car design.

U.S. Pat. No. 763,186 discloses a general hopper car and specifically a door operating mechanism for a hopper car, also called a "dumping car" therein.

U.S. Pat. No. 797,341 discloses a reinforced central hopper type hopper car.

U.S. Pat. No. 881,884 discloses a general hopper car and specifically a door operating mechanism for a hopper car, also called a "dumping car" therein.

U.S. Pat. No. 891,325 discloses a general hopper car and specifically a hopper lining for an ore car.

U.S. Pat. No. 914,242 discloses a general hopper car also called a "dump car" therein.

U.S. Pat. No. 937,419 discloses a general hopper car also called a "dump car" therein.

U.S. Pat. No. 1,182,642 discloses a general hopper car also called a "dump car" therein.

U.S. Pat. No. 1,300,959 discloses a general hopper car also called a "hopper dump car" therein, which shows the beginnings of multiple hoppers and distinct transverse doors for the individual hoppers, that is most common today.

U.S. Pat. No. 1,418,907 discloses a general hopper car and specifically a door operating mechanism for a hopper car, also called a "dump car" therein.

U.S. Pat. No. 1,444,730 discloses a general hopper car and specifically a door operating mechanism for a hopper car, also called a "hopper bottom" therein.

U.S. Pat. No. 2,079,862 discloses a general hopper car and specifically a center-sill design for use therein.

U.S. Pat. No. 3,080,829 discloses a ballast hopper car and specifically a ballast distributing hopper car.

U.S. Pat. No. 3,104,623 discloses a general hopper car and specifically a door locking structure for a hopper railcar.

U.S. Pat. No. 3,187,684 discloses a general hopper car and specifically a door opening system for a hopper railcar.

U.S. Pat. No. 3,242,878 discloses a "shallow" hopper car design.

U.S. Pat. No. 3,256,836 discloses a general hopper car and specifically a door opening system for a hopper railcar.

U.S. Pat. No. 3,348,501 discloses a general hopper car and specifically a sliding door opening system for a hopper railcar.

U.S. Pat. No. 3,509,827 discloses an aluminum body hopper car.

U.S. Pat. No. 3,577,932 discloses a hopper car and specifically a door opening system for a hopper railcar.

U.S. Pat. No. 4,228,742 discloses a hopper car, also called a "vehicle hopper" therein, having longitudinally spaced hopper end slope sheets and hopper cross ridge slope sheets formed prior to assembly.

U.S. Pat. No. 4,292,898 discloses a hopper car including an elongated, load bearing body having walls formed of a specified fiber reinforced plastic resin composite of glass reinforcing filaments and a structural "organo-polymeric" resin.

U.S. Pat. No. 4,361,096 discloses a hopper car including seals to prevent seepage of a fine granular commodity between the hopper doors and the adjacent hopper sheets of a railroad hopper car of the type having opposed pairs of hopper doors swingable between a closed position and a downwardly depending open position. The seals comprise elongated strips of flexible material with their upper longitudinal edge portions mounted along the inside lower edges of the inner and outer hopper sheets and being of a width such that their free lower longitudinal edge portions extend downwardly beyond the lower edges of the hopper sheets. The free edge portions of the seals being bent inwardly by and lying in sealing engagement against the hopper doors when the hopper doors are in their closed position. Similar strips of flexible material may be so located as to form a seal between the upper portion of each hopper door and its adjacent slope sheet.

U.S. Pat. No. 4,366,757 discloses a hopper railcar apparatus for actuating and locking each pair of hopper doors of a railroad hopper car of the type having a plurality of hopper doors arranged in opposed pairs and extending transversely of the hopper car center sill.

U.S. Pat. No. 4,376,542 discloses a gasket structure for application to a hopper car door edge comprises an elongated flexible gasket of compressible material having a relatively thick body with a continuous tangentially projecting rib and a plurality of narrow elongated spring clips extending transversely of the gasket and each having a straight end portion underlying the gasket and riveted to the rib thereof, a straight intermediate portion angularly disposed with respect to the straight end portion, and an opposite end portion curved in the opposite direction with respect to the intermediate portion from the angulation of the straight end portion to form a nearly closed loop, the straight end portion being adapted to engage the inner surface of the hopper door web with the intermediate portion engaging the sloping peripheral rim of the hopper door and with the opposite end grippingly engaging the outer surface of the peripheral rim to secure the gasket against the door web.

U.S. Pat. No. 4,644,871 discloses an articulated hopper railcar with a designated "short distance" between truck centers. The railcar features two bodies supported by a center truck and two end trucks, wherein the center truck takes somewhat more loading than the other two end trucks.

U.S. Pat. No. 4,884,511 discloses an aluminum body hopper railcar with having a center sill hood which uses aluminum collar castings.

U.S. Pat. No. 5,070,793 discloses a sidewall and top chord member for an open top gondola or hopper railway car developed by a predecessor in interest to the assignee. The top chord member is a lightweight rectangular tubular extrusion of aluminum having a pair of spaced wear pads on the top surface thereof to contact rotary or shaker type car unloading equipment.

U.S. Pat. No. 5,249,531 discloses actuating system for operating the doors of a railroad hopper car. A plurality of levers for each hopper operate to rotate the doors of the hopper between an open and a closed position and also provides an over center latch to positively close each door.

U.S. Pat. No. 5,417,165 discloses a railroad hopper ballast discharge door assembly includes pliant side panels along a discharge gate opening. The pliant side panels are strong enough to retain the ballast within the hopper when the door is closed, yet are flexible enough to yield when ballast flowing out of the hopper becomes wedged between the side panel and the door as the door closes.

U.S. Pat. No. 5,934,200, developed by the assignee, discloses a lightweight hopper-type rail car designed to minimize aerodynamic drag and including a cross ridge arrangement to increase the fabrication efficiency of the car.

U.S. Pat. No. 5,979,335 discloses a fully protective multi-unit railroad freight car for carrying motor vehicles on two or three levels with the lowest level being in a cargo well between a pair of deep side sills. A pair of vehicle-carrying decks are adjustable in height and are counterbalanced against each other during adjustment of their locations.

U.S. Pat. No. 6,273,004 discloses a sidewall structure for a motor-vehicle carrying railway car wherein at least one upper deck is supported principally by longitudinal beams that are themselves supported by end structures, without the need for large, heavy vertical posts to support the decks between the end structures.

U.S. Pat. No. 6,334,397 discloses side sheet construction for a hopper railcar, also called a bulk container car, side sheet assembly for a rail car having a pair of horizontally extending upper and lower side sheets form with a plurality of longitudinally extending strengthening ribs. The upper and lower side sheets are affixed to each other at a horizontal seam to either form flat connection or a rib at the horizontal seam.

U.S. Pat. No. 6,405,658 discloses a manual discharge door operating system for a hopper railcar which is provided with an over-center closed position to hold the door in the closed position.

U.S. Pat. No. 6,955,127 discloses actuating system for manually operating the doors of a railroad hopper car.

U.S. Pat. No. 7,080,599 discloses an actuating system for operating transverse doors of a railroad hopper car which close in an over center position. The mechanism includes an operating member which is coupled to a door or doors of the car by a shaft and a linkage which couples a power source to the operating member, where the operating member rotates to move the door away from the hopper. The mechanism can operate doors which open in opposed direction with a single power source. The mechanism can be used in new car construction, and can be retrofitted onto existing hopper cars.

U.S. Patent Publication 2006/0254456 discloses a general hopper railcar and a transverse door operating system with an over-center door locking or closed position.

U.S. Patent Publication 2008/0066642 discloses a general hopper railcar with seal member or seal member assembly that is mounted to one or both of the closure members. When open, the seal member or seal member assembly lies substantially flush with, or shy of, the slope of the surface of the closure member. When closed, the seal member may be self-energizing, in the sense that as lading is added the seal may tend to seal more tightly. The seal assembly may include a cantilevered spring that presents a land to the opposed closure member, and a fulcrum, over, or across, which the spring is cantilevered, such that pushing down on one end of the spring may tend to cause the other end to flex upward. The fulcrum may also be cantilevered outward from the slope sheet of the closure member to which the seal assembly is attached. The discharge section may be robustly reinforced to discourage deformation.

U.S. Patent Publication 2009/0007813 discloses a general hopper railcar with opposed double doors for discharging cargo from a hopper car.

The prior art has provided a variety of open top hopper railroad cars. The above listed patents are representative of the state of the art of hopper railcars and these patents and published applications are incorporated by reference herein in their entireties. There remains a need for sidewall structure designs that can more easily be adapted to distinct clearance profiles found in distinct jurisdictions thus increase the carrying capacity of the associated car. Further there is a need to provide for simple efficient door seal that assists to secure the doors in an over center locked position. Further there is a need to provide door designs that better accommodates end door configuration to assure complete lading discharge.

SUMMARY OF THE INVENTION

It is an object of the present invention to provide an open top hopper railcar with side contoured open top hopper railcar with biased door seal and enlarged contoured end door.

One embodiment of the present invention provides a railroad open top hopper car comprises a pair of spaced trucks; and a railcar body supported on the trucks, the body comprising a pair of side structures on opposed sides of the railcar, wherein each side structure includes (i) a top chord extending the length of the side structure, (ii) a plurality of upper side stakes extending from the top chord, (iii) an intermediate side chord extending the length of the side structure and vertically below the top chord and coupled to the upper side stakes, (iv) a plurality of lower side stakes extending from the intermediate side chord, and (v) a side sill extending the length of the side structure and vertically below the intermediate side chord and coupled to the lower side stakes.

According to one aspect of the invention the railroad car body bottom forms a plurality of discharge chutes forming pockets for the body which open to the interior with a plurality of intermediate doors and end doors, wherein the end doors are positioned on end pockets and are larger than the intermediate doors.

According to one aspect of the invention each door includes a biased door seal, with each door seal including a door seal member secured within a chamber for movement toward and away from a respective door, and a biasing member biasing the sealing member toward the door.

These and other advantages of the present invention will be clarified in the brief description of the preferred embodiment taken together with the drawings in which like reference numerals represent like elements throughout.

BRIEF DESCRIPTION OF THE DRAWINGS

FIG. 1 is a side elevation view of a pair of side contoured open top hopper railcars each with biased door seals and enlarged contoured end doors in accordance with one aspect of the present invention;

FIG. 2 is a cross section view of one of the railcars of FIG. 1, illustrating the contoured side structure according to one aspect of the present invention;

FIG. 3A is an enlarged section view of a lading shedding top side chord coupled to one upper side stake forming part of contoured side structure of the railcar of FIG. 1 according to one aspect of the present invention;

FIG. 3B is a perspective view of a portion of the side top chord of FIG. 3A;

FIG. 3C is a sectional view of the side top chord of FIG. 3A;

FIG. 4A is an enlarged section view of an intermediate side chord coupled to one upper side stake and one lower side stake forming part of contoured side structure of the railcar of FIG. 1 according to one aspect of the present invention;

FIG. 4B is a perspective view of a portion of the intermediate side chord of FIG. 4A;

FIG. 4C is a sectional view of the intermediate side chord of FIG. 4A;

FIG. 5A is an enlarged section view of an offset bottom side sill coupled to one lower side stake forming part of contoured side structure of the railcar of FIG. 1 according to one aspect of the present invention;

FIG. 10 is a perspective view illustrating only the doors and associated operating mechanism for the railcar of FIG. 1 according to one aspect of the present invention;

FIG. 11 illustrates a modified door according to another aspect of the present invention for use with the railcar of FIG. 1;

DESCRIPTION OF THE PREFERRED EMBODIMENTS

Figure 5C:
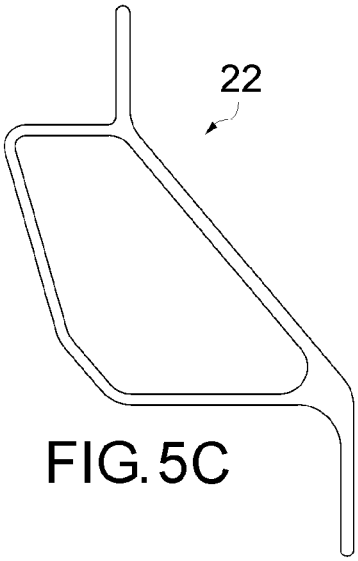
FIG. 5C is a sectional view of the side sill of FIG. 5A.

The present invention provides a side contoured open top hopper railcar 10 each with biased door seals and enlarged contoured end doors as will be described hereinafter. Each railcar 10 includes a number of conventional features that need not be described herein in detail as they are well known in the art, including an under frame structure (including center sill 46) formed on a pair of spaced trucks (not numbered) and couplers for connecting adjacent cars 10. These conventional elements can be formed in a variety of known methods. For example the Assignee's proprietary cold formed center sill provides numerous advantages to the center sill 46 structure of the car 10, but other known sill designs can be utilized.

The railcar 10 is described as a side contoured railcar because the structure of the side walls of the car allow the car 10 to easily accommodate other clearance envelopes with other than a straight down side wall. As will be further described hereinafter the term contoured side within the meaning of this patent application defines a side that does not follow a straight line from the side top chord (e.g., top chord 12) to the bottom side sill (e.g., bottom side sill 22). Every railway governing authority around the world has established a clearance envelope in which cars must fit in order to safely operate on the designated lines. The clearance envelope likewise will establish where trackside accessories, tunnels, bridges, etc. need to be in order to not interfere with the railcars. Further, within a jurisdiction or on a specialized line, such as a car in captive service for a utility, there may be an alternative clearance envelope. Obviously, there is a desire to have any car fit within the envelope as closely as possible to maximize the potential carrying capacity of the resulting car. Additionally, the car must do so while maintaining the required or desired center of gravity and minimizing the overall weight of the car.

The sides of the railcar 10 of the present invention include a lading shedding side top chord 12 coupled to extruded upper side stakes 18 as best shown in FIG. 3A. The top chord 12 is lading shedding as this profile has a top surface angled toward the interior of the hopper car 10 so that lading landing on the top of the top chord 12 will be directed by gravity toward the interior of the hopper as can be seen in FIGS. 3A-3C. Additionally the attachment web of the top chord 12 will be spaced from the outside edge of the top chord 12 by the approximate depth of the upper side stakes 18 as shown in FIG. 3A. The top chord 12 may be an aluminum extrusion.

The upper side stakes 18 can be aluminum supports formed in a hat shaped arrangement in a manner similar to existing side stakes. The depth and width of the side stakes 18 will primarily be determined by the required strength for each support, however other design characteristics may be considered, such as altering the cross sectional shape to improve the aerodynamics of the moving railcar 10. However the main difference between the upper side stakes 18 of the railcar 10 and conventional side stakes is that the upper side stakes 18 do not extend from the top chord 12 to the bottom side sill 22. In contrast to this conventional arrangement the upper side stakes 18 extend from the top chord 12 to an intermediate side chord 16 as best shown in FIG. 4A.

The form of the intermediate side chord 16 is best illustrated in FIGS. 4A-4C. The intermediate side chord 16 is mechanically coupled to upper side stakes 18 on one side thereof and lower side stakes 19 on an opposite side thereof as best illustrated in FIG. 4A. The intermediate side chord 16 is an important component of the contoured side structure of the railcar 10 and is best illustrated in FIGS. 4A-4C. The attachment webs for the side chord 16 are not aligned (i.e. coplanar) which allows for easy construction of the contoured construction (i.e. non-linear) of the sides of the rail car 10. The distance between the attachment webs of the side chord 16 and the outside edge of the side chord 16 will roughly be equal to the depth of the upper and lower side stakes 18 and 19. The side chord 16 may be an aluminum extrusion.

Figure 5B:
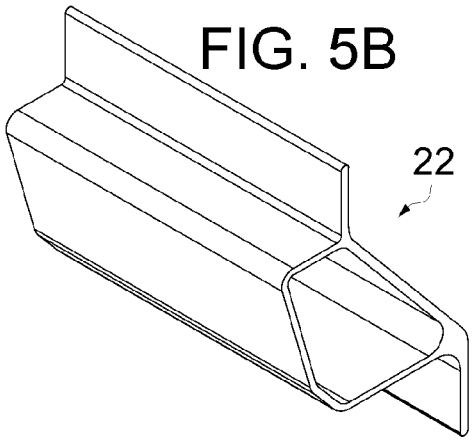
FIG. 5B is a perspective view of a portion of the side sill of FIG. 5A.
Figure 6:
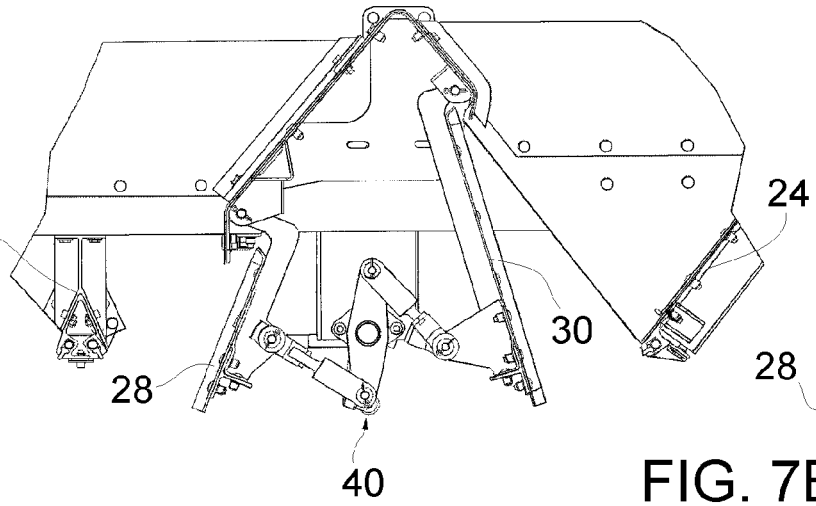
FIG. 6 is a side elevation view of an intermediate pocket door and an enlarged contoured end pocket door with associated operating mechanism of the railcar of FIG. 1.

The lower side stakes 19 may be formed aluminum sections the same as the upper side stakes 18 in cross section, although other alternative shapes may be used. The lower side stakes 19 extend from the intermediate side chord 16 down to an offset bottom side sill 22. The offset side sill 22 also is designed to assist in accommodating the contoured side structure of the railcar 10. The side sill 22 is best illustrated in FIGS. 5A-5C. The side sill 22 may be an aluminum extrusion. The distance between the upper attachment web of the side sill 22 and the outside edge of the side sill 22 will roughly be equal to the depth of the lower side stake 19.

Upper aluminum sheets or plates 14 and lower aluminum sheets or plates 20 complete the side structure. The upper and lower sheets 14 and 20 are attached to respective side stakes 18 and 19 in a conventional fashion. The upper sheets 14 can also be attached to the top chord 12 and the side chord 16, while the lower sheets 20 can be attached to the side sill 22 and the side chord 16.

The interior of the railcar 10 includes bracing structure as shown in FIG. 2. The bracing will be in "k bracing" format including cross members 32 extending between the sides and diagonal members 34 extending to the center of the railcar 10. Mounting brackets 34 and 38 accommodate the bracing members. The intermediate side chord 16 allows the mounting brackets 34 to be easily attached thereto rather than off of the upper side chord 12, providing additional structural advantages to the present design.

The contoured design of the side structure of the railcar 10 as shown and described allows the car to be easily designed to fit within a wide variety of envelopes. The envelope shown is well suited for applications in the Australian and Asian markets. The term contoured within this application when associated with the side structure intends to construe that the side structure is not vertical or straight from top chord to side sill. Slight changes in the geometry of the side chord 16 and possibly in the geometry of the side sill 22 allows alternative envelope configurations to be closely matched. It should be noted that the present side wall construction could be utilized in a non-contoured arrangement in which the attaching webs of the side chord 16 would be effectively parallel or coplanar and aligned.

A further alternative design contemplated with the side structure of the railcar 10 of the present invention is an all inside stake car design or, more providing greater design flexibility, alternating between inside and outside stakes on the same side wall design. An inside stake configuration for the railcar 10 would simply require changing the location of the attaching webs for the top chord 20, side chord 16 and bottom side sill 22, and reversing the orientation of the side stakes 18 and 20. Additionally the top surface of the side sill 22 and side chord 16 may be angled to prevent lading from collecting thereon. The inside stake position may alter some cross bracing locations as well. A particularly interesting alternative is to have the upper side stakes 18 be formed as inside stakes and the lower side stakes 19 be outside stakes, or vise versa. This alternative allows designers to mix the advantages of outside and inside stakes to best accommodate carrying capacity and center of gravity issues with greater flexibility. These advantages stem mainly from the use of the intermediate side chord 16.

The top chord 12, intermediate chord 16 and side sill 22 of the present invention are shown as closed section members that can be formed as aluminum extrusions. Open section shapes are also possible but the closed sections offer some structural advantages. Additionally the interior of the various sections can be used as protected conduit space if needed for electrical, hydraulic or pneumatic lines running the length of the car. Although the space within the center sill 46 is usually convenient and sufficient and desirable for many uses.

Another alternative design for the contoured side railcar 10 according to another embodiment of the present invention is the use of bent side stakes (not shown) that conform to the designed shape for the outer envelope and having the bent side stakes extend from the top chord 12 to the side sill 22, thereby omitting the intermediate side chord 16. This alternative design raises some concerns regarding the strength of the bent side stakes, but may offer some weight savings without having the additional intermediate chord.

The railcar 10 includes endwalls 24 that are conventional and will extend from an end top chord similar to top chord 12 described above. Wear plates or corner caps can be provided to easily accommodate rotary unloading.

The car bottom forms a plurality of discharge chutes 26 which open to the interior with a plurality of intermediate doors 28 and end doors 30. Between each pair of opposed doors 28 or 28 and 30 there is provided a door operating mechanism 40 operating on the doors. The details of the door operating mechanism are not discussed herein in detail and a variety of operating systems can be used. Pneumatically powered systems, hydraulically powered systems, manually operated or manual overrides can also be included. The preference stated herein is that the system operates on opposed doors as shown. Additionally it is a preference if the locking position is an over center locking position such that the weight of the laden on the door will work to secure the door in the closed position.

As known in the art the interior of the chutes 26 and the endplates 24 form sloping floors to allow the lading or commodity to be discharged through the open doors in the bottom of the car 10. There has been a constant problem with the incomplete unloading of such hopper cars due to friction between the commodity in the container surface and/or cohesion between the commodity and the container surface, the latter often being caused by freezing.

This incomplete unloading is a particular problem in the coal industry. Coal carry back, coal that is retained in the hopper cars after unloading, presents a multi-pronged productivity challenge because it results in an increase in the number of hopper cars needed to deliver a given-amount of coal, an increase in the fuel costs for the "dead head" return trip of the "empty" hopper car to the source of the coal, and minimized the amount of "new" coal in the subsequent loading.

Figure 7B:
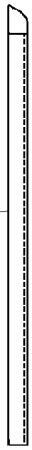
FIG. 7B is a side elevation view of the intermediate door of FIG. 7A.
Figure 7A:
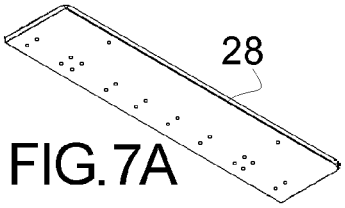
FIG. 7A is a perspective view of an intermediate door of the railcar of FIG. 1.
Figure 7C:
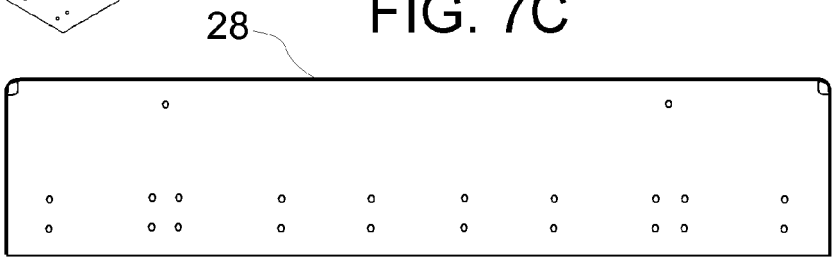
FIG. 7C is a plan view of the intermediate door of FIG. 7A.
Figure 8A:
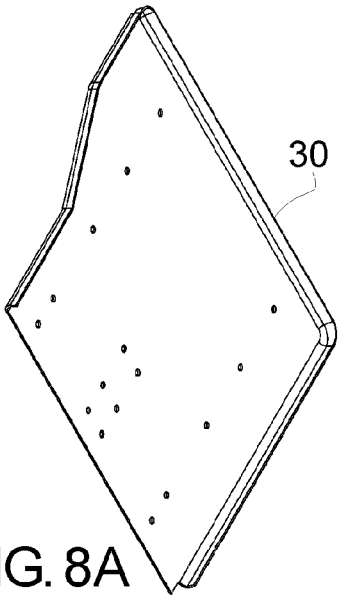
FIG. 8A is a perspective view of one side contoured end door of the railcar of FIG. 1.
Figure 9A:
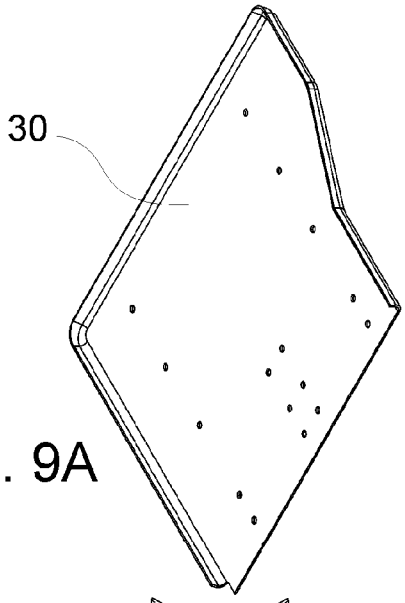
FIG. 9A is a perspective view of another side contoured end door of the railcar of FIG. 1 which is opposite of the door of FIG. 8A.
Figure 8B:
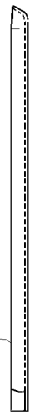
FIG. 8B is a side elevation view of the end door of FIG. 8A.
Figure 9B:
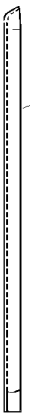
FIG. 9B is a side elevation view of the end door of FIG. 9A.
Figure 8C:
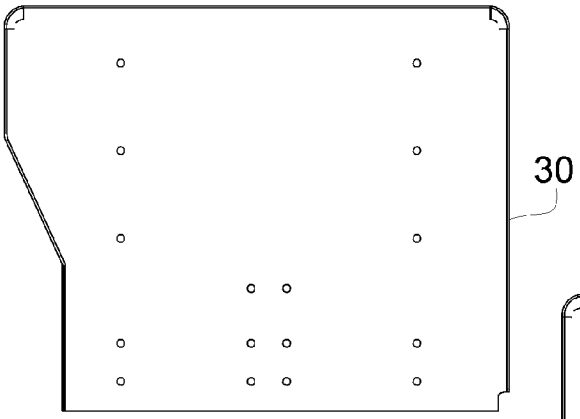
FIG. 8C is a plan view of the end door of FIG. 8A.
Figure 9C:
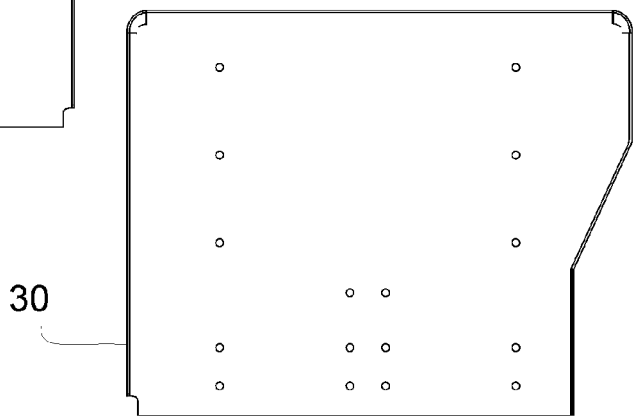
FIG. 9C is a plan view of the end door of FIG. 9A.

The present design attempts to minimize this problematic issue through the door design. In the chutes 26 between the end pockets of the hopper car 10 conventional opposed doors 28 provide easy freely flowing discharge. The intermediate doors 28 are shown in FIGS. 7A-7C and will be effectively uniform along the car except for the end pockets. The end pocket openings, also called door throats, for end pocket doors 30 are enlarged to better accommodate flow though these areas. The end pockets would otherwise be susceptible to bridging of the lading across the throat if the smaller door opening of the intermediate door 28 were used on the end pocket. With the increased opening size of about 75% larger than the throat of the opening for doors 28, the end doors 30 will now have one door 30 on each side of the center sill 46. The two doors 30 are shown in FIGS. 8A-C and FIGS. 9A-C respectively. There is believed to be no additional advantage to having the enlarged contoured doors 30 along the length of the car 10. Having the enlarged contoured doors 30 only on the end pockets is believed to provide the most efficient solution. The contour of the doors 30 is best seen in the plan views of the doors 30. The doors 28 and 30 may be formed of aluminum pans while the ridge structure may be formed of steel members.

An alternative door spreader design is shown in FIG. 11 and represents a design intended to better spread the door operating forces across the door 28. As shown in FIG. 11 the door spreader includes a deep hat channel member extending across the door to which a plurality of door actuating arms 42 is coupled.

Hopper cars of the type contemplated are frequently used to haul fine, granular commodities such as wet rock, sand, aggregates, grain, or the like. It has been found that such fine, granular, fluid-type commodities can, under some circumstances, seep between the hopper door and the lower edges of the adjacent inner and outer hopper sheets. When the hopper doors are in their closed position, a tight metal-to-metal seal in the prior art door designs is not always achieved between the hopper doors and the adjacent inner and outer hopper sheets. The over center locking or closed position definitely assists in having a tight seal, but such a door operating mechanism does not completely eliminate lading seepage.

Figure 12:
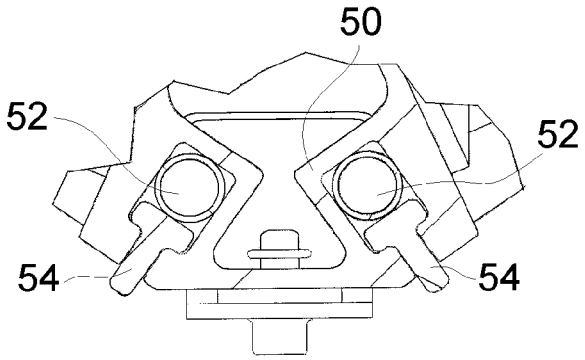
FIG. 12 is a side elevation of biased door seals for the intermediate doors of the railcar of FIG. 1 according to one aspect of the present invention.

The present invention provides a tensioned or biased door seal for each door 28 or 30 as best shown in FIG. 12. The door seal includes an intermediate door seal housing 50 for the pairs of intermediate doors 28. Each housing 50 includes a door seal member 54 secured within a chamber for movement toward and away from a respective door 28. The door seal member 54 is preferably a rubber, polymeric or composite material to assist in the seal with the door. Further the sealing member 54 is under tension toward the door through a biasing member 52. The biasing member 52 may be a compressible tube, wherein the amount of force exerted on the member 54 can be adjusted by adjusting the pneumatic or hydraulic pressure within the tube. Alternatively a steel spring member, such as a leaf spring, or collection of leaf springs, or coil springs, could also form the biasing member 52. Further a "solid" compressible member could form the biasing member 52.

The biasing member 52 and sealing members 54 combine to form a tight seal against the doors 28 or 30 when the doors are in the closed position. Additionally the biasing force against the doors keep the doors in the closed position when an over center linkage is used to operate the doors. In other words keeping additional tension on the doors prevent the over center doors from "bouncing" into the open position.

Figure 13B:
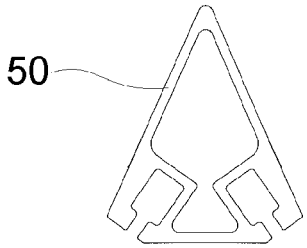
FIG. 13B is a side elevation of the intermediate door seal housing member of FIG. 13A.
Figure 13A:
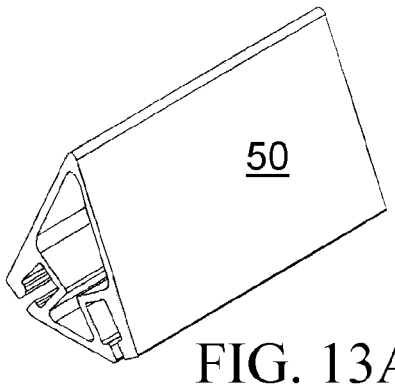
FIG. 13A is a perspective view of the intermediate door seal housing member of FIG. 12.
Figure 14B:
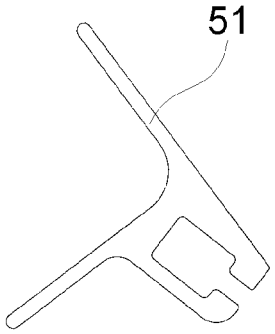
FIG. 14B is a side elevation of the intermediate door seal housing member of FIG. 13A.
Figure 14A:
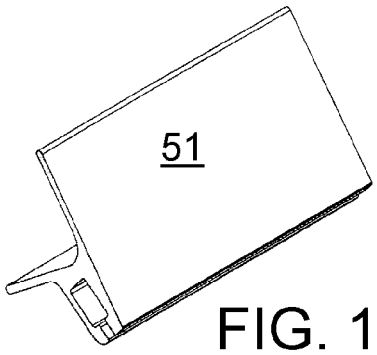
FIG. 14A is a perspective view of an end door seal housing member of a biased door seal for one pair of end doors of the railcar of FIG. 1.

The intermediate seal housing 50 is shown in FIGS. 13A-13B, while the end pocket door housing 51 is illustrated in FIGS. 14A-14B. There is no significant difference in the seal for the end doors 30 other than the housing 51 need only be for doors on one side and the sealing member 52 need only match the lengths of the adjacent doors 30.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention should be defined by the appended claims and equivalents thereto.

What is claimed is:

1. A railroad open top hopper car comprising:

A pair of spaced trucks;

A railcar body supported on the trucks, the body comprising a pair of side structures on opposed sides of the railcar, wherein each side structure includes (i) a top chord extending the length of the side structure;

(ii) a plurality of upper side stakes extending from the top chord;

(iii) an intermediate side chord extending the length of the side structure and vertically below the top chord and coupled to the upper side stakes, wherein the intermediate side chord includes upper and lower attachment webs;

(iv) a plurality of lower side stakes extending from the intermediate side chord; and (v) a side sill extending the length of the side structure and below the intermediate side chord and coupled to the lower side stakes, and wherein the upper and lower attachment webs of the intermediate side chord are configured to be secured to the upper and lower side stakes, respectively, and wherein the attachment webs for the intermediate side chord are not aligned forming a contoured side structure construction of the side structures of the rail car.

2. The railcar of claim 1 wherein a railroad car body bottom forms a plurality of discharge chutes forming pockets for the body which open to the interior with a plurality of intermediate doors and end doors, wherein the end doors are positioned on end pockets and are larger than the intermediate doors.

3. The railcar of claim 1 wherein each door includes a biased door seal, with each door seal including a door seal member secured within a chamber for movement toward and away from a respective door, and a biasing member biasing the sealing member toward the door.

4. The railcar of claim 1 wherein the top chord has a top surface angled toward the interior of the hopper car so that lading landing on the top of the top chord will be directed by gravity toward the interior of the hopper.

5. The railcar of claim 1 wherein the top chord, the intermediate side chord and side sill are formed of closed section aluminum extrusions.

6. The railcar of claim 1 wherein the side structures further include upper aluminum sheets and lower aluminum sheets.

7. The railcar of claim 1 wherein the interior of the railcar includes bracing structure coupled to the intermediate side chord.

8. The railcar of claim 1 wherein at least one of the upper side stakes and the lower side stakes is formed as outside stakes for the railcar side structure.

9. A railroad open top hopper car comprising:

A pair of spaced trucks;

A railcar body supported on the trucks, the body comprising a pair of side structures on opposed sides of the railcar defining an interior hopper filled from above with lading, wherein each side structure includes a top chord extending the length of the side structure and a side sill extending the length of the side structure, a plurality of upper side stakes extending from the top chord, an intermediate side chord extending the length of the side structure and vertically below the top chord and coupled to the upper side stakes, wherein the intermediate side chord includes upper and lower attachment webs, a plurality of lower side stakes extending from the intermediate side chord, and wherein the intermediate side chord includes upper and lower attachment webs configured to be secured to the upper and lower side stakes, respectively, and wherein the attachment webs for the intermediate side chord are not aligned forming a contoured side structure construction of the side structures of the rail car; and A railroad car body bottom which forms a plurality of discharge chutes forming pockets for the body which open to the hopper interior with a plurality of intermediate doors and end doors for discharging lading from the interior hopper, wherein the end doors are positioned on end pockets and are larger than the intermediate doors.

10. The railcar of claim 9 wherein each door includes a biased door seal, with each door seal including a door seal member secured within a chamber for movement toward and away from a respective door, and a biasing member biasing the sealing member toward the door.

11. The railcar of claim 9 wherein the top chord has a top surface angled toward the interior of the hopper car so that lading landing on the top of the top chord will be directed by gravity toward the interior of the hopper.

12. The railcar of claim 9 wherein the top chord and side sill are formed of closed section aluminum extrusions.

13. The railcar of claim 9 further including a door operating mechanism operating on opposed sets of doors.

14. The railcar of claim 9 wherein the end doors are configures to provide an increased opening size of about 75% larger than the throat of the opening for the intermediate doors.

* * * * *